US010060251B2

(12) United States Patent
Stokely

(10) Patent No.: US 10,060,251 B2
(45) Date of Patent: Aug. 28, 2018

(54) ACOUSTIC MEASUREMENT OF WELLBORE CONDITIONS

(71) Applicant: Halliburton Energy Services, Inc., Houston, TX (US)

(72) Inventor: Christopher Lee Stokely, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 57 days.

(21) Appl. No.: 14/909,875

(22) PCT Filed: Nov. 19, 2013

(86) PCT No.: PCT/US2013/070756

§ 371 (c)(1),
(2) Date: Feb. 3, 2016

(87) PCT Pub. No.: WO2015/076782

PCT Pub. Date: May 28, 2015

(65) Prior Publication Data

US 2016/0177708 A1 Jun. 23, 2016

(51) Int. Cl.
*E21B 47/10* (2012.01)
*E21B 47/12* (2012.01)

(52) U.S. Cl.
CPC ..... *E21B 47/101* (2013.01); *E21B 47/123* (2013.01)

(58) Field of Classification Search
None
See application file for complete search history.

(56) References Cited

U.S. PATENT DOCUMENTS 4,628,725 A * 12/1986 Gouilloud ..... E21B 47/101 367/31
4,876,889 A * 10/1989 Shakkottai ..... G01N 29/024 374/119
6,401,538 B1 * 6/2002 Han ..... E21B 47/101 73/19.03

(Continued)

FOREIGN PATENT DOCUMENTS

WO WO-2009130620 A1 10/2009
WO WO-2013045941 A1 4/2013
WO WO-2015076782 A1 5/2015

OTHER PUBLICATIONS

"International Application Serial No. PCT/US2013/070756, International Search Report dated Aug. 21, 2014", 3 pgs.

(Continued)

*Primary Examiner* — Jill Culler
(74) *Attorney, Agent, or Firm* — Chamberlain Hrdlicka

(57) ABSTRACT

A method of measuring fluid flow conditions in a wellbore includes generating an acoustic probe signal during fluid flow along the wellbore, measuring the performance attribute of the acoustic probe signal within a target frequency range, and of the fluid medium in at least a part of the wellbore based on the measured performance parameters. The target frequency range of the acoustic probe signal encompasses a bubble resonance frequency range for vapor bubbles in the wellbore, for example having frequencies in excess of 20 kHz. An estimated bubble size value may be calculated based on determining a frequency at which the measured probe signal experiences the retardation or peak attenuation.

21 Claims, 6 Drawing Sheets

(56) References Cited

U.S. PATENT DOCUMENTS

| | | | | |
|---|---|---|---|---|
| 6,672,163 | B2 * | 1/2004 | Han | E21B 47/101 73/597 |
| 2011/0280103 | A1 | 11/2011 | Bostick, III | |
| 2012/0092960 | A1 | 4/2012 | Gaston et al. | |
| 2012/0277995 | A1 | 11/2012 | Hartog et al. | |

OTHER PUBLICATIONS

"International Application Serial No. PCT/US2013/070756, Written Opinion dated Aug. 21, 2014", 5 pgs.

* cited by examiner

ACOUSTIC MEASUREMENT OF WELLBORE CONDITIONS

PRIORITY APPLICATIONS

This application is a U.S. National Stage Filing under 35 U.S.C. 371 from international Application No. PCT/US2013/070756, filed on 19 Nov. 2013, and published as WO 2015/076782 A1 on 28 May 2015, which application and publication are incorporated herein by reference in their entirety.

TECHNICAL FIELD

The present application relates generally to determination of fluid conditions in a wellbore. Some example embodiments relate to methods and systems to measure fluid flow conditions by acoustic interrogation of the wellbore. Some aspects of the disclosure relate to methods and systems for determining a phase composition of wellbore fluid by acoustic interrogation of the wellbore. Other aspects of the disclosure relate to drilling installations and/or wellbore installations comprising a fluid flow monitoring system configured for measuring characteristics of wellbore fluid flow.

BACKGROUND

In drilling and production operations for the extraction of liquid and/or gas assets from the Earth (for example, in the extraction of hydrocarbon fluids such as oil and natural gas), accuracy of measurement information indicating, e.g., a rate of flow of a fluid mixture upwards along a subterranean borehole or wellbore may be greatly dependent on the particular fluid flow conditions in the wellbore (or at different points along the which wellbore). A particular fluid flow measurement value, for example, indicative of rates of flow of a bubbly mixture along the wellbore, may vary dependent on a phase composition of the bubbly fluid mixture at the respective points of measurement.

Pressure and temperature conditions vary greatly along the wellbore, causing significant variation on fluid flow characteristics of different fluids and/or different fluid phases along the length of the borehole. Downhole pressures are usually sufficiently large that, for example, natural gas extracted via the wellbore are in the liquid phase for a portion of its flow along the wellbore, transitioning to the vapor phase (or gas phase, used synonymously herein) at a particular fluid pressure, temperature, and fluid composition, typically corresponding to a particular location (or bubble point) along the wellbore. When natural gas, for example, comes out of solution, significant cooling may occur due to the liquid-to-vapor phase change. This can cause freezing in some instances, particularly in subsea applications where the production of methane-water crystals, i.e. clathrate hydrates, can be problematic.

Fluid behavior is significantly dependent on the phase and composition of fluid flowing along the wellbore. Fluid flow measuring equipment may thus, e.g., provide flow rate measurements that are susceptible to misinterpretation based on inaccurate phase composition information.

Reliable interpretation of measured fluid flow parameters is thus, to some extent, dependent on accurate assessment of fluid composition at the location along the wellbore where the measurement was taken. Accurate measurement and/or monitoring of downhole fluid flow conditions, however, is typically complicated by significant wellbore depths, sometimes being located in remote locations, e.g., at off-shore drilling installations.

BRIEF DESCRIPTION OF THE DRAWINGS

Some embodiments are illustrated by way of example and not limitation in the figures of the accompanying drawings, in which.

DETAILED DESCRIPTION

The following detailed description refers to the accompanying drawings that depict various details of examples selected to show how aspects of this disclosure may be practiced. The discussion addresses various examples of the disclosed subject matter at least partially in reference to these drawings, and describes the depicted embodiments in sufficient detail to enable those skilled in the art to practice the subject matter disclosed herein. Many other embodiments may be utilized for practicing the disclosed subject matter other than the illustrative examples discussed herein, and structural and operational changes in addition to the alternatives specifically discussed herein may be made without departing from the scope of the disclosed subject matter.

In this description, references to "one embodiment" or "an embodiment," or to "one example" or "an example," in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, and all legal equivalents of such claims.

An example embodiment of this disclosure comprises a system and method for measuring of fluid flow conditions in a wellbore by measuring behavior of an acoustic probe signal in fluid medium within the wellbore, and, in an automated operation, determining estimated phase composition of the fluid medium based on measured attributes values for the acoustic probe signal. The method may thus comprise calculation of a vapor fraction and/or a liquid fraction for the fluid medium at one or more points of the wellbore.

The method may comprise determining a bubble size parameter for vapor phase content of the fluid medium at one or more positions along the wellbore, and deriving estimated phase fractions from the bubble size parameter.

Figure 1:
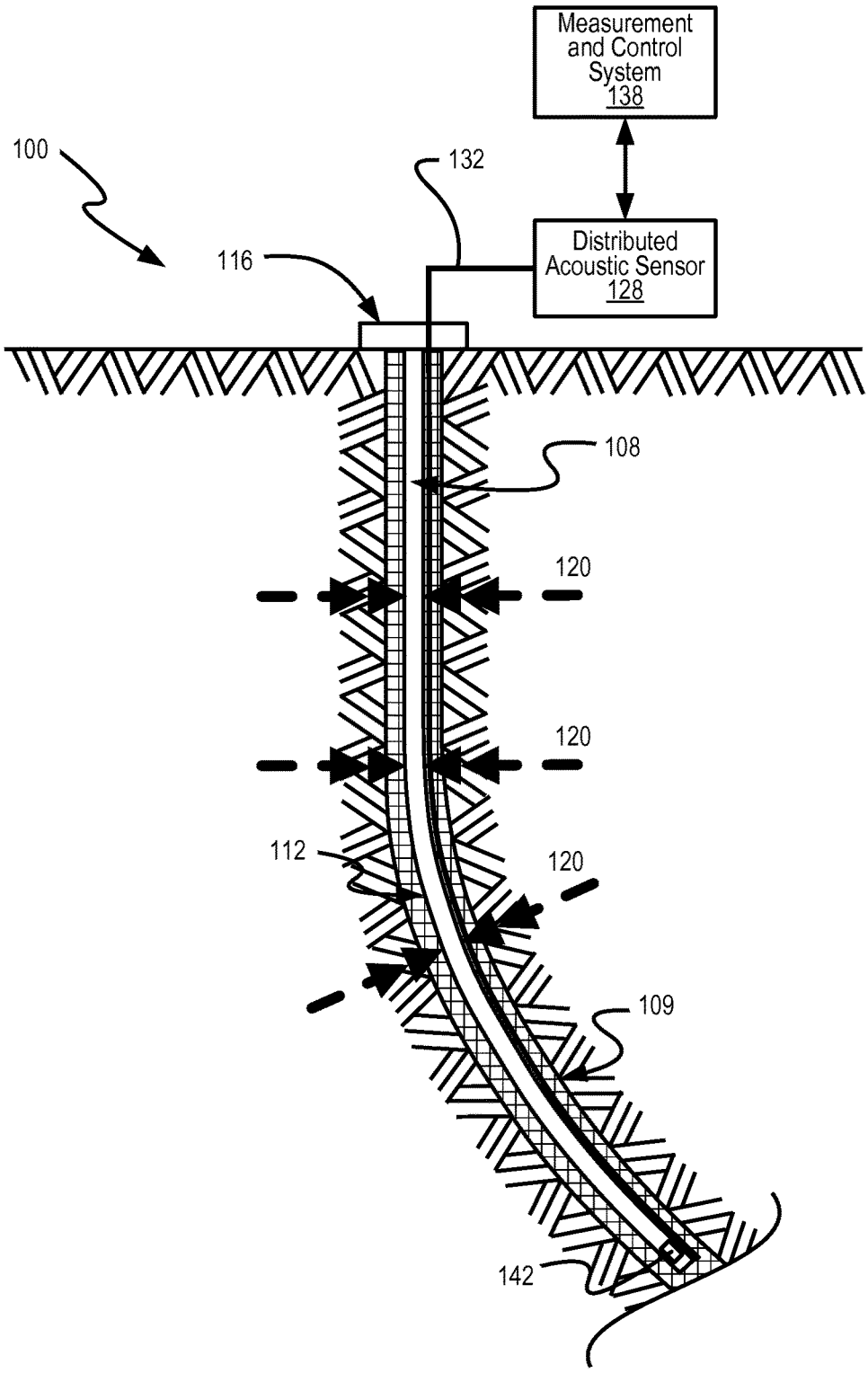
FIG. 1 is a schematic view, in elevation, of a wellbore installation in accordance with an example embodiment, the drilling installation comprising a wellbore provided with an acoustic wellbore monitoring system to monitor fluid flow conditions in the wellbore.

FIG. 1 is a schematic view of an example wellbore installation 100 to measure and/or monitor fluid flow conditions in a subterranean formation, in this example embodiment being provided in association with a wellbore 108 drilled in the earth for the production of natural gas. The wellbore 108 comprises an elongated cylindrical borehole 109 drilled in the Earth and lined with a metallic casing 112 that extends substantially continuously along the borehole 109 and covering a cylindrical wall of the borehole 109, to form a hollow cylindrical conduit along which production fluid, e.g. a mixture of liquid and vapor, can be conducted to a wellhead 116 at the Earth's surface.

An annular space between the production casing 112 and a cylindrical wall of the borehole 109 may be filled with an impervious material (e.g., cement) for at least some portions of the length of the wellbore 108, to prevent inflow of liquids radially into the fluid conduit provided by the wellbore 108 in such backfilled portions. Other portions of the wellbore 108 along its length may be specifically configured to be permeable to radial movement of hydrocarbons from the Earth formation into the wellbore 108, thus forming a plurality of production zones 120 spaced along the length of the wellbore 108. In some instances, the wellbore 108 does not necessarily comprise production zones 120 that are segregated by such structural components of the wellbore 108, but naturally occurring production zones 120 may nevertheless exist because of variations in geological formations through which the wellbore 108 extends.

The wellbore installation 100 further comprises an acoustic sensor to measure acoustic behavior of a known acoustic probe signal in the fluid medium within the wellbore 108. In this example embodiment, the acoustic sensor is in the example form of a fiber optic distributed acoustic sensor (DAS) 128 comprising a length of optical fiber cable 132 attached to the casing 112 and extending along the length of the casing 112. In this example embodiment, the fiber-optic cable 132 is attached to an outer radial surface of the casing 112, and is therefore not located in the fluid conduit of the wellbore 108. The acoustic sensor 128 may form part of a measurement and control system 138 comprising electronic equipment operatively connected to an acoustic sensor 128 for measurement and control as well as signal processing purposes. As is known to persons of skilled in the art, the DAS 128 may function through the introduction of an optical signal into the wellbore 108 such that acoustic behavior of the fluid in the wellbore 108 can be derived by measuring distortions of optical waves within the conduit due to transient pressure differences in the fluid medium when acoustic waves are perpetuated along the wellbore 108. The distributed acoustic sensor 128 is thus configured in accordance with established methodologies to measure acoustic behavior in the fluid medium within the wellbore 108 at different points along the length of the wellbore 108.

Figure 5C:
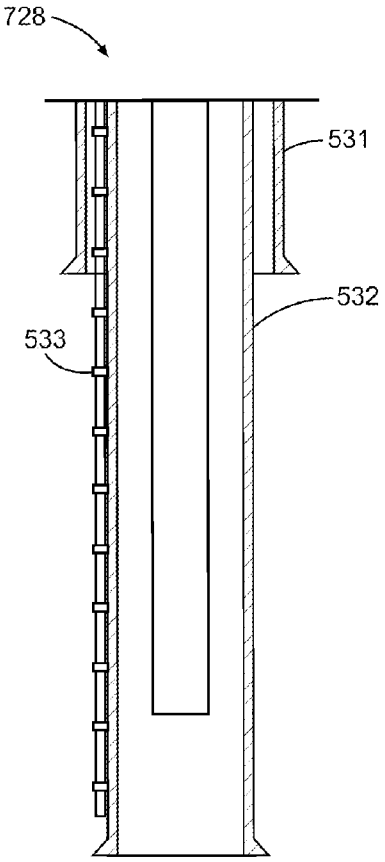
FIGS. 5A-5C depict schematic elevational sections of respective configurations for deployment of distributed acoustic sensing systems in a drilling installation, in accordance with respective example embodiments.
Figure 5B:
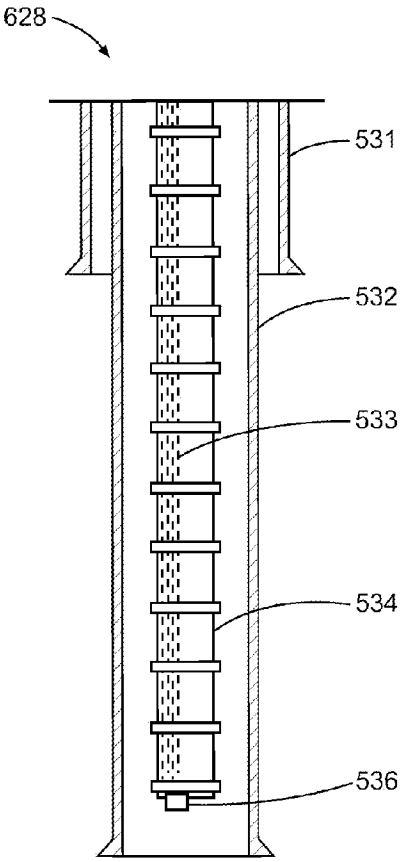
Figure 5A:
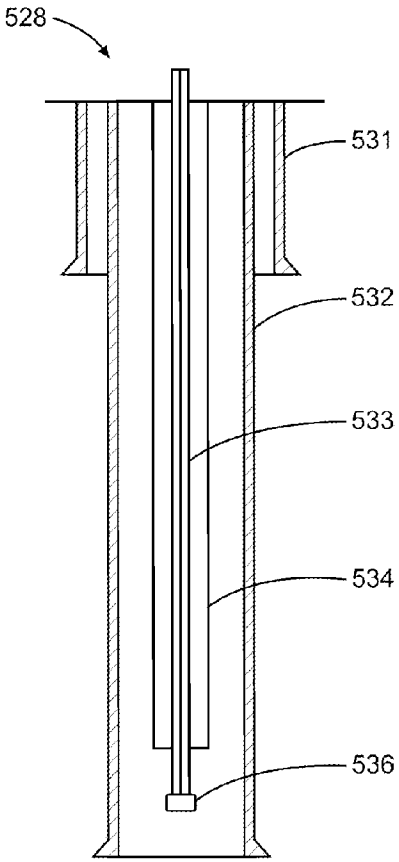

Some possible configurations for deployment of distributed acoustic sensor systems in and around a wellbore are shown in FIGS. 5A-5C. It will be appreciated that the illustrated example configurations are a nonexhaustive set of possible configurations. The system 528 of FIG. 5A comprises a retrievable wireline in which a fiber optic cable 533 is deployed within metal tubing 534 and down to a bottom hole gauge or termination 536. The metal tubing 534 is surrounded by production casing 532, which is in turn surrounded by a surface casing 531 near the surface. The system 628 of FIG. 5B shows a permanent tubing installation in which a fiber optic cable 533 is attached to metal tubing 534. Finally, the system 728 of FIG. 5C represents a casing attachment in which the fiber-optic cable 533 is attached to the outside of the production casing 532.

Acoustic sensors other than the above-described fiber-optic distributed acoustic sensor may be used in other embodiments. The acoustic sensor may, for example, comprise point systems known in the art as fiber Bragg gratings. In such case, measurement signals from multiple fiber Bragg gratings may be multiplexed to achieve distributed measurements of the acoustic probe signal.

The measurement and control system 138 further comprises a computer system having one or more processors configured to receive and interpret measurement information from the optical fiber cable 132, thereby to derive information about acoustic wave activity within the wellbore 108.

The wellbore installation 100 also comprises an acoustic signal generator to generate an acoustic probe signals in the wellbore 108. In this example embodiment, the acoustic probe signal comprises a transient acoustic wave signal, e.g., a sound wave, in the form of an acoustic pulse introduced into the fluid medium of the wellbore 108 by a pulse generator 142, the probe signal being propagated along the wellbore 108 via the fluid medium. The example acoustic probe signal thus comprises a short acoustic pulse generated in the wellbore fluid medium explicitly for the purposes of measuring characteristics of fluid flow in the wellbore 108. The acoustic pulse can, for example, be a single dramatic pulse, a short monotone pulse, or a short modulated pulse.

In this example embodiment, the acoustic source (e.g., the sound generator 142) may be located downhole, so that the acoustic probe signal propagates upwards along the wellbore 108. The location of the sound generator 142, and the amplitude and phase of pulses generated by the sound generator 142 are selected such that the pulse is distorted, either by attenuation or dispersion, or both (which depend on acoustic frequency and the bubble size) where bubbles in gaseous form are expected to occur. In other example embodiments, the source of sound created in the fluid medium for the purposes of acoustic fluid flow condition monitoring may be located at or adjacent the wellhead 116. In yet other embodiments, fluid flow monitoring may be performed based not on a dedicated acoustic probe signal, but may instead (or in addition) employ existing environmental noise or ambient noise in the wellbore 108.

Note that different types of acoustic probe signals may be used in different embodiments. The acoustic probe signal can, for example comprise sounds emitted as continuous single-frequency tones, continuous DTMF (Dual Tone Multiple Frequency, similar to that which is commonly used for pushbutton telephones), continuous multiple-frequency tones, continuous wide spectrum tones, continuous white noise, continuous colored noise, continuously repeating swept-frequency waveforms, continuous pseudorandom waveforms, or other continuously repeating complex waveforms. The sounds can also be emitted as pulsed single-frequency tones, pulsed dual tone DTMF, pulsed multiple-frequency tones, pulsed wide spectrum tones pulsed white noise, pulsed colored noise, pulsed swept-frequency waveforms, pulsed pseudorandom waveforms, or other pulsed complex waveforms. The sounds can be transmitted in synchrony. The sounds can be transmitted at different volumes at each location. The scope of this disclosure is not limited to any particular predetermined acoustic signals transmitted by an acoustic source.

Figure 3:
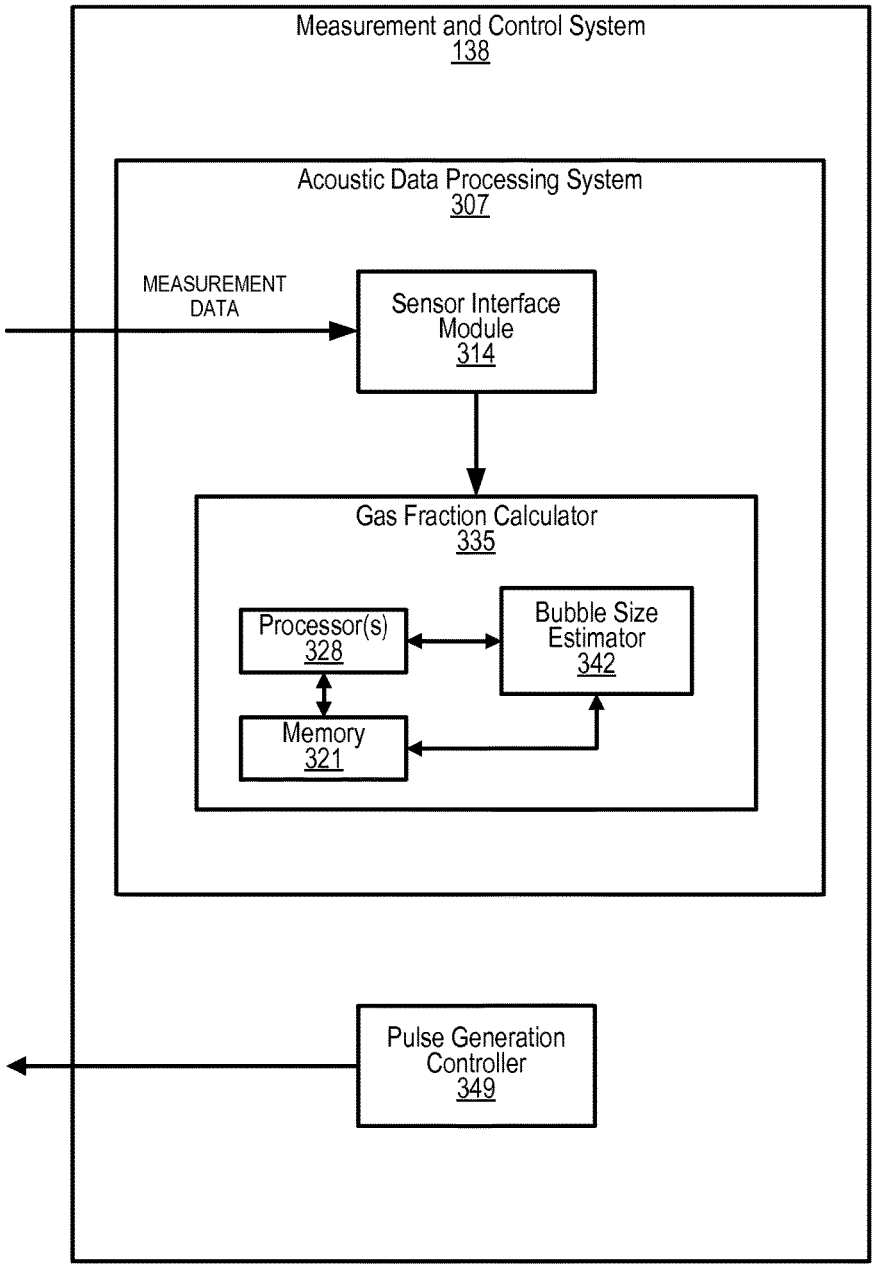
FIG. 3 is a schematic block diagram of acoustic measurement analysis module(s) forming part of a wellbore monitoring system, in accordance with an example embodiment.

The probe signal generator may be configured to generate acoustic probe signals in response to explicit single-instance operator commands, in which case the measurement and control system 138 can may include a pulse generation controller 349 (FIG. 3). In other example embodiments, however, the probe signal generator can be configured to trigger intermittently, periodically, on a predetermined operator-configurable schedule.

The pulse generator 142 may be configured to generate a short pulse such that the acoustic probe signal comprises a large range of frequencies, for example comprising a broadband pulse. In this example embodiment, the pulse generator 142 is configured such that a target frequency range of the distributed acoustic sensor 128 (e.g., comprising substantially a range of frequencies that are present in the probe signal and which the distributed acoustic sensor 128 and the measurement and control system 138 are configured to measure) substantially encompasses a particular bubble resonance frequency range for the fluid medium and flow conditions which are monitored by means of the wellbore installation 100. The particular bubble resonance frequency range comprises a range of resonant frequencies corresponding to a range of individual bubble sizes characteristic of vapor bubbles formed in the particular fluid medium during fluid flow in the wellbore 108.

Note in this regard that a sound wave is resonant with a vapor bubble in a fluid medium when a diameter of the vapor bubble substantially corresponds to the wavelength of sound wave. A vapor-phase bubble of air with a diameter of 1 cm would at standard pressure, for example, be resonant with an acoustic wave having a frequency of about 326 Hz.

Note that a distinction is made between different types of gaseous globules or vapor-filled cavities based on scale, distinguishing between vapor bubbles and vapor pockets. In this disclosure, a "bubble" comprises a vapor-phase formation that has a diameter of about 5 cm or less, with substantially larger vapor-phase formations comprising "pockets" in the fluid medium. A natural gas globule with a diameter of 15 cm, for example, therefore comprises a vapor pocket (not a vapor bubble), while a 3 mm globule of vapor-phase natural gas in the fluid medium comprises a vapor bubble (but not a vapor pocket). Note further that the term "diameter," has used herein applies not only to spherical bubbles, but is also applicable to any other shapes which bubbles may in practice have. Vapor bubbles can, for example, sometimes be dome-shaped or broadly disc-shaped, e.g., with a convex upper surface and a concave lower surface. Such non-spherical bubbles are in some cases known as "cap bubbles," in analogy to the shape of a construction worker's hardhat. The term "diameter" as used herein means the largest possible straight line dimension between any two points on a surface or periphery of a particular bubble (for a spherical bubble thus lying along a straight line passing through the center of the bubble).

Figure 2:
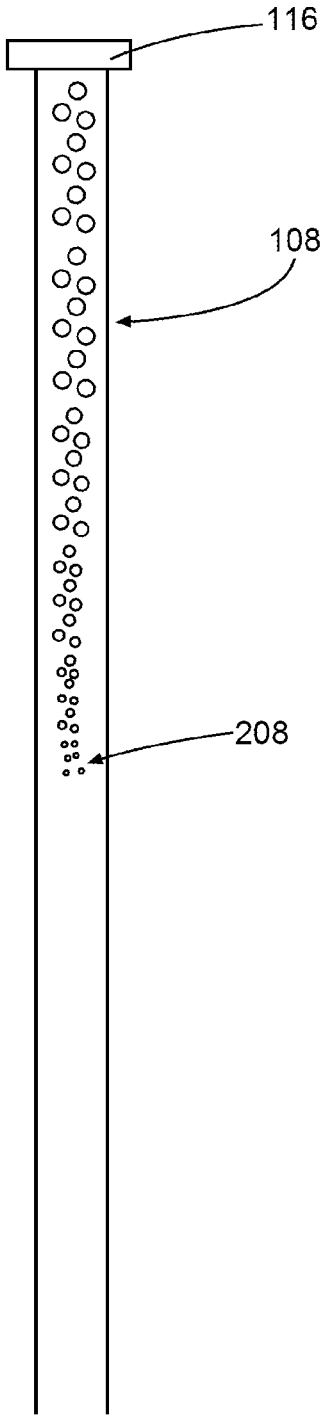
FIG. 2 is a schematic elevation, in elevation and on an enlarged scale, of a wellbore installation, pictorially illustrating a characteristic distribution of vapor bubbles in a fluid medium during fluid flow along a wellbore conduit.

As mentioned previously, and as illustrated schematically in FIG. 2, natural gas in the fluid medium is typically in the liquid phase below a bubble point 308 in the wellbore 108, the bubble point 308 comprising a point along the wellbore 108 at which pressure and temperature in the fluid medium within the wellbore 108 lies substantially on a boiling/condensation phase-change curve for the particular fluid medium. Being a watery mixture, thermodynamic behavior of the fluid medium in the example wellbore 108 can often correspond substantially with that of water. Natural gas produced by the wellbore 108 transitions from liquid to vapor (and vice versa). Average bubble size typically increase progressively upwards away from the bubble point 308 because of progressively decreasing liquid pressure in the fluid medium.

FIG. 3 is a schematic view of an example acoustic data processing system 307 forming part of the measurement and control system 138 to process acoustic measurement data gathered by the distributed acoustic sensor 128, to determine or derive fluid flow conditions in the wellbore 108. The processing system 307 comprises a sensor interface module 314 to receive acoustic measurement data from the distributed acoustic sensor 128, the acoustic data being indicative of one or more performance attributes of the acoustic probe signal in the fluid medium within the wellbore 108, as measured by the distributed acoustic sensor 128.

The acoustic data processing system 307 may further comprise a memory 321 to store acoustic measurement data (which may be time series data), and may further comprise one or more processors 328 that are communicatively coupled to the sensor interface module 314 and the memory 321 to receive the acoustic data. In this example, the processor(s) 328 is provided by one or more computer(s), but in other embodiments, the processor(s) 328 and the respective functional subunits may be in the form of application-specific integrated circuits (ASICS).

The acoustic data processing system 307 is thus configured to provide vapor fraction calculator 335 to determine a vapor fraction of the fluid medium in at least a part of the wellbore 108, based at least in part on the one or more measured performance attributes of the acoustic probe signal. Differently defined, the vapor fraction calculator 335 is configured to calculate or estimate the phase composition of the fluid medium for at least a portion of its length along the wellbore 108, thus determining relative proportions of the fluid medium (at the relevant portion(s) of the wellbore 108) that is in the liquid phase and the vapor phase respectively.

In this example embodiment, the vapor fraction calculator 335 is configured to calculate or estimate the vapor fraction based at least in part on a speed parameter of the acoustic probe signal, as measured by the distributed the distributed acoustic sensor 128. In other example embodiments, the performance attributes of the acoustic probe signal that are measured by the distributed acoustic sensor 128, and on which vapor fraction calculation is based may comprise an attenuation parameter of the acoustic probe signal in the corresponding location along the wellbore 108. Example methodologies that may be employed by the acoustic data processing system 307 for automated vapor fraction calculation in accordance with the example embodiments are described in greater length below.

The vapor fraction calculator 335 may comprise a bubble size estimator 342 for estimating a bubble size parameter for vapor bubbles in the fluid medium in at least part of the wellbore 108, the vapor fraction calculator 335 being configured to determine the vapor fraction based at least in part on the bubble size parameter calculated by the bubble size estimator 342. As will be described in further detail below, the bubble size parameter may comprise a collective bubble size value for a multitude of vapor bubbles that are present in the fluid medium at the relevant portion thereof (e.g., at a particular production zone), the collective bubble size value being, for example, statistically representative of individual bubble sizes for the multitude of vapor bubbles. Thus, for example, the collective bubble size value may be an average bubble size value, a mean bubble size value, a median bubble size value, a statistical parameter of that indicates a statistical distribution of bubble sizes, or the like. The bubble size estimator 342 may, for example, be configured to estimate the bubble size parameter by identifying an inflection frequency at which the measured performance attributes of the acoustic probe signal displays a minimum/maximum inflection within the particular bubble resonance frequency range. This may comprise, e.g., identifying a frequency at which the speed of propagation of the acoustic probe signal in the fluid medium is at a minimum, or identifying a frequency at which a level of attenuation of the acoustic probe signal in the fluid medium is at a maximum. A wavelength corresponding to such a peak retardation frequency or a peak attenuation frequency may in some example embodiments be taken as a statistically representative bubble diameter.

The functionalities of the acoustic data processing system 307 and its associated modules (e.g., the vapor fraction calculator 335 and the bubble size estimator 342) are described in more detail below with reference to description of corresponding operations in an example embodiment of a method of measuring fluid flow conditions in a in an elongated subterranean cavity such as the example wellbore 108, the example method being diagrammatically illustrated in FIG. 4 by schematic flowchart 400.

The method may comprise exposing the fluid medium in the wellbore 108 to an acoustic probe signal, at operation 403, in this example comprising a transient signal in the form of an acoustic pulse generated by means of the pulse generator 142. As mentioned, the acoustic probe signal in this example embodiment comprises a short, broadband modulated pulse that comprises a range of frequencies including the particular bubble resonance frequency range for the bubbly mixture of gas and water that comprises the fluid medium within the wellbore 108. In this example embodiment, the fluid medium is a watery medium, with hydrocarbon fluids entering the wellbore 108 at the plurality of production zones 120 (see, e.g. FIG. 2) flowing into the wellbore conduit, joining the mixture. As previously explained with reference to FIG. 2, natural gas extracted via the wellbore 108 is in condensate form below the bubble point 308 (FIG. 2) and transitions to vapor phase bubbles above the bubble point 308 below the bubble point 308.

The particular fluid medium that is contained in the wellbore 108 and in which vapor bubbles whose properties are investigated by means of the acoustic probe signal is known to an operator of the wellbore installation 100 to characteristically form vapor-filled cavities in zones of interest of the wellbore 108 that vary in size between microscopic bubbles and vapor pockets having a diameter approaching or equaling that of the wellbore, about 10 cm to 15 cm. The acoustic probe signal, in this example embodiment, may be configured to produce an acoustic probe signal with a target frequency range spanning substantially the whole spectrum of vapor phase formations (including both bubbles and larger vapor phase formations). The acoustic probe signal therefore encompasses a particular bubble resonance frequency range corresponding to a characteristic range of individual bubble sizes in the fluid medium during fluid flow, in this example being 1 mm to 5 cm. The particular bubble resonance frequency range in this example embodiment may therefore be 100 Hz-30 kHz, with the target frequency range being, e.g., 50 Hz-50 kHz. In this example embodiment, the acoustic data processing system 307 is in other words calibrated to detect vapor bubble formation ranging in size from 1 mm to 5 cm, while also detecting larger vapor formations ranging in size up to 15 cm. The acoustic probe signal is accordingly configured such that the range of frequencies included in the acoustic probe signal substantially spans or encompasses (and therefore includes multiple frequencies within) the particular bubble resonance frequency range for the fluid medium.

The method further comprises measuring, at operation 405, the speed of propagation of the acoustic probe signal through the fluid medium by means of the distributed acoustic sensor 128, so that the performance attribute of the acoustic probe signal in this example embodiment comprises the speed of sound wave propagation in the fluid medium. The speed of acoustic probe signal components may be measured at a plurality of measurement locations spaced along the wellbore 108, in this example particularly comprising measurement locations at the respective production zones 120.

Figure 4:
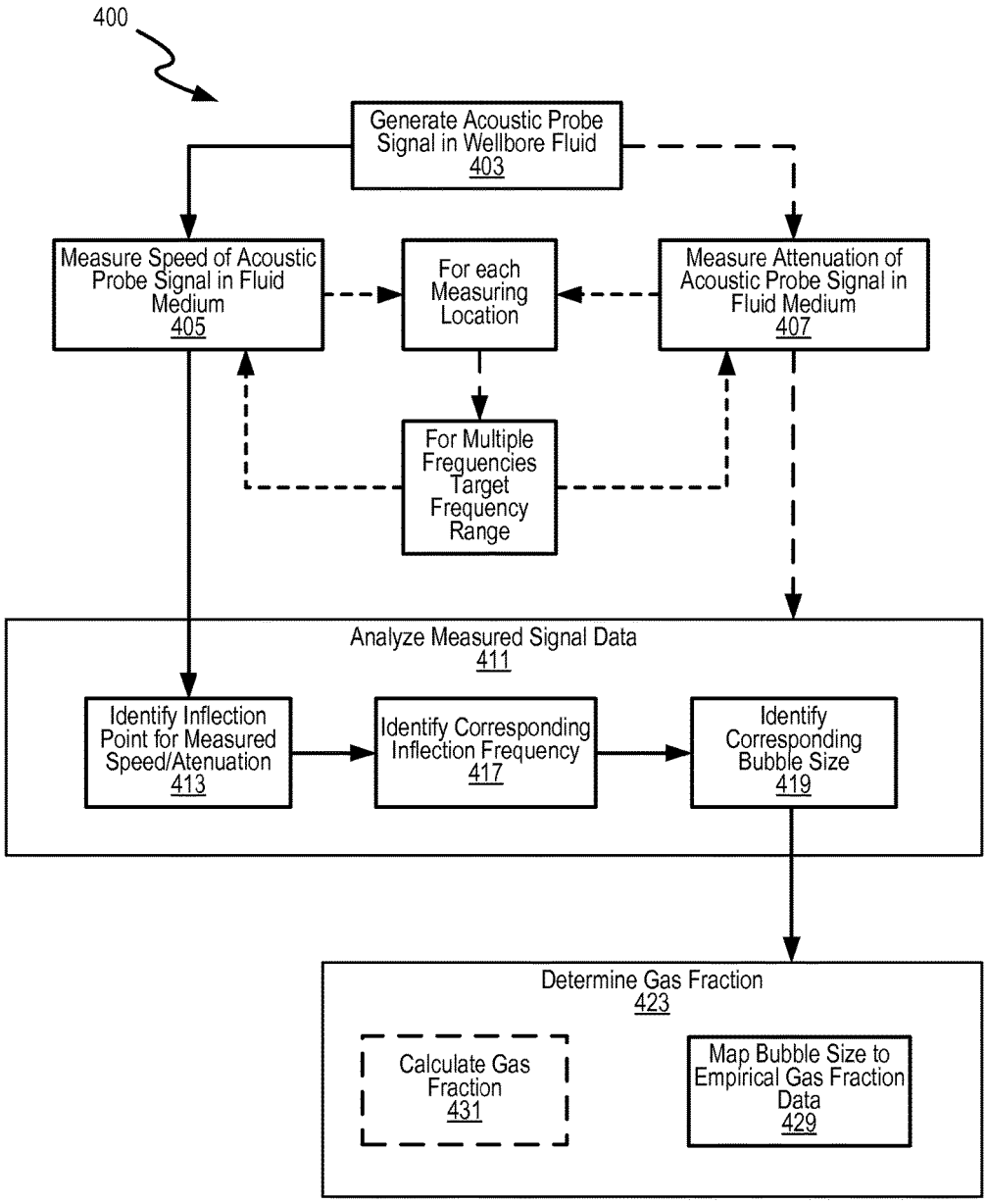
FIG. 4 is a schematic flow diagram of an example method of monitoring fluid flow conditions in a subterranean wellbore, in accordance with an example embodiment.

In other embodiments, as indicated by operation 407 in FIG. 4, the performance attribute of the acoustic probe signal that may be measured by means of the distributed acoustic sensor 128 in order to determine the bubble size distribution, may include measurements of attenuation levels of the acoustic probe signals at various points along the wellbore 108. Note that, in some embodiments, the method may comprise measuring both speed and attenuation of the acoustic probe signal at discrete points along wellbore 108, in which case bubble size distribution parameters derived from the measurements may be correlated between values produced from the speed measurements and the attenuation measurements respectively.

Note that measuring the speed of the acoustic probe signal (at operation 405) may comprise measuring (at each of the measurement locations) a multiplicity of frequency-specific speeds of the acoustic probe signal at the respective location. It will be appreciated that the acoustic probe signal comprises multiple components at different frequencies spanning the target frequency range, and that the acoustic probe signal components at different frequencies may be affected differently by the particular fluid medium conditions, so that there may be variations between the respective frequency components of the acoustic probe signal.

The method may further comprise analyzing, at operation 411, the frequency-specific signal data thus measured at the respective measurement locations, to identify, at operation 413, an inflection point for the acoustic probe signal's measured speed at each of the respective measurement locations, and therefrom identifying a corresponding inflection frequency, at operation 417. This may comprise analyzing the multiple speed values for different frequencies to find a particular frequency at which the speed of sound in the fluid medium is at a minimum, thus identifying an inflection frequency (in this instance a peak retardation frequency) that corresponds to the minimum signal speed for the acoustic probe signal.

The method may further comprise, at operation 419, identifying a bubble size corresponding to the peak retardation frequency as a bubble size parameter that provides a collective bubble size value for vapor bubbles present in the fluid medium at the respective measurement location. In this example embodiment, for example, the minimum signal speed at a particular measurement location is identified as occurring at an acoustic probe signal frequency 3200 Hz, so that the peak retardation frequency is determined as being 3200 Hz. Based on this identified peak retardation frequency, a corresponding statistically representative bubble size value for the fluid medium at the respective measurement location is estimated as being 1 cm (for a bubble point pressure of 100 atmospheres for a some given hydrocarbons). Note that estimated bubble size value is not estimated to be substantially equal to the wavelength of the acoustic probe signal at the peak retardation frequency. Instead, the system 307 is configured to estimate the bubble size value at an order of magnitude greater than the wavelength of the acoustic probe signal at the peak retardation frequency. See in this regard discussion of Minnaert resonance below. The system 307 is thus in this example embodiment configured to estimate the bubble size value as the inverse of the peak retardation frequency multiplied by a factor of 32.

As mentioned previously, the method may instead, or in addition, comprise identifying the inflection frequency based on measured attenuation values, in which case the infection frequency comprises a peak attenuation frequency corresponding to a maximum attenuation level for frequency-specific attenuation measurement values at respective measurement locations. In other example embodiments, the multiple frequency-specific behavior measurements (e.g., speed or attenuation levels) of the acoustic probe signal may serve as input for automated analysis by the acoustic data processing system 307 to establish not only a particular statistical representative bubble size parameter, but also to identify information regarding bubble size distribution at the respective measurement locations, e.g., by inspecting or analyzing mathematical or statistical properties of a normal distribution curve for bubble sizes, as indicated by corresponding distribution of speed/attenuation values for various frequencies in the particular bubble resonance frequency range.

The method may further comprise, at operation 423, determining a vapor fraction of the fluid medium at the respective measurement locations based at least in part on the bubble size parameter previously identified, e.g., in operation 419. Determination of the vapor fraction at operation 423 may comprise an automated computer-implemented operation of mapping the established parameters to a corresponding vapor fraction, at operation 429, based on empirically established data for the particular fluid medium and/or wellbore 108. In one embodiment, the established bubble size parameter may be correlated to a corresponding vapor fraction based on empirical data reflecting bubble size-vapor fraction relationships applicable to the particular wellbore 108. In such instances, vapor fraction values may be established empirically or experimentally for various bubble sizes and speed values. A vapor fraction value can thus be derived from such prior empirically established data based on the estimated bubble size and the minimum measured speed of the acoustic probe signal at the peak retardation frequency.

In other embodiments (schematically shown in flowchart 400 by alternative/parallel operation 431), the vapor fraction may be determined by automated calculation, at operation 431, based on an analytically established relationship between the vapor fraction, bubble size, and acoustic propagation speed or attenuation level for the fluid medium. Such a relationship may include various other known or measurable variables and/or constants (such as those, e.g., mentioned with reference to the Silberman equations below).

Note in this regard that the speed of sound, as well as the attenuation of sound within a fluid is significantly dependent on the vapor fraction in the watery medium. The speed of sound waves, and the attenuation of the sound waves, within the fluid is, however, also dependent on the bubble size of the gas comprising the vapor fraction. The speed of sound in the bubbly fluid is altered by increased compressibility of the medium, while attenuation is related to the damped, out-of-phase pulsation by the sound waves. Some of this pulsation is converted into heat and some converted to new sound waves out of phase with the incident wave. The bubble size distribution, volume ratio of air to water, and sound frequency all affect the acoustic properties of the medium.

As mentioned, acoustic attenuation is a maximum when the wavelength of the sound is at peak attenuation/retardation frequency bubble radius, while sound velocity is at a minimum. Attenuation is large for wavelengths much larger than the size of the bubbles. Existing or proposed acoustic measurements using acoustic sensing in wellbores employ acoustic waves of which the dominant frequencies are often below 5000 Hz. Depending on the bubble point pressure, a 1 cm diameter bubble would be resonant with an acoustic wave a frequency greater than about 300 Hz (near surface pressures) to 3000 Hz (near the downhole bubble point pressure). These measurements are therefore made for resonance wavelengths much larger than the bubble size. Measurements with probe signals far away from peak retardation/attenuation frequencies for vapor bubbles (an instance of which is described, e.g., in WO 2013/045941 to Godfrey, et al.), measures near negligible attenuation of an acoustic wave or near negligible decrease in the speed of the sound wave to indicate the presence of bubble formation or to identify much larger vapor pockets, no bubble size determination can be based thereon. Vapor fraction calculation or gas concentration determination based on these existing measurements is thus not feasible.

In some examples, vapor fraction calculation based on a particular bubble size parameter may comprise or be analogous to relationships set out by Edward Silberman in, "*Sound Velocity and Attenuation in Bubbly Mixtures Measured in Standing Wave Tubes*," The Journal of the Acoustical Society of America, Volume 29, Number 8, p. 925-933, August 1957, which discusses theory and measurements in water with various bubble generators, although Silberman does not propose or suggest characterizing bubble content by measuring the speed of sound in the bubbly mixture or by measuring the acoustic attenuation of the sound as it traverses the wellbore. Relevant equations for describing acoustic propagation in a bubbly medium for a homogeneous mixture containing spherical bubbles of uniform radius much smaller than the wavelength of sound are set out below. In these equations, relevant parameters are:

a—Parameter, $$\frac{B_0}{\gamma P_0}$$

B—Bulk modulus of elasticity of the fluid.

b—Parameter $C_p$—Specific heat of air at constant pressure c—Phase velocity of sound in unbounded air-water mixture $c_m$—Phase velocity of sound as measured in a standpipe E—Modulus of elasticity of pipe wall material D—Pipe diameter f—Frequency $f_r$—Bubble resonance frequency $f^*$—$f/f_r$ h—Pressure head of atmosphere at top of air-water mixture column K—Thermal conductivity of air l—Length of air-water mixture region N—Rate of formation of air bubbles, Hz n—Number of quarter wavelengths from the surface in pipe
P—Relative root-mean-square value of fluctuating sound pressure at a given point
$P_0$—Undisturbed pressure at bubbles
r—Undisturbed bubble radius
S—Cross-sectional area of pipe
V—Volume of air bubbles
v—Concentration
w—Rate of rise of air bubbles
x—Distance along centerline of pipe measured positively upward from source of sound
X,Y—Parameters
y—Thickness of pipe wall
α—Attenuation constant
γ—Adiabatic exponent
δ—Damping factor for individual bubble
$\delta^*$—$\delta f^{*2}$
η—Coefficient of viscosity
λ—Wavelength of sound in air-water mixture
μ—Polytroptic factor
ρ—Density of air-water mixture
$\rho_G$—Density of air in undisturbed bubble The salient equations are:

$$\left(\frac{c_0}{c}\right)^2 = \left(\frac{1+aX}{2}\right)\left\{1 \pm \left(1+\left(\frac{1+aY}{1+aX}\right)^2\right)^{\frac{1}{2}}\right\}$$

$$\alpha = \frac{\pi f}{c_0} \cdot \frac{c_0}{c} \cdot aY$$

$$X = \frac{v(1-f_*^2)}{(1-f_*^2)^2+\delta_*^2}$$

$$Y = \frac{v\delta_*}{(1-f_*^2)^2+\delta_*^2}$$

$$a = \frac{\rho c_0^2}{\gamma P_0} \approx \frac{B_0}{\gamma P_0}$$

$$f_* = f / f_r$$

$$f_r = \frac{1}{2\pi r}\left(\frac{3\mu\gamma P_0}{\rho}\right)^{\frac{1}{2}}$$

$$\delta_* = \delta f_*^2$$

The positive size is used in the first of these equations when $$-\alpha v < 1 - f_*^2 < 0$$

The expression for $f_r$ is known as the Minnaert resonance. For a bubble in water at standard pressure ($\gamma P_0$=100 kPα, ρ=1000 kg/m$^3$), this equation reduces to $$f_r \sim \frac{326}{r}(\text{Hz} \cdot \text{cm})$$

Thus the resonance frequency would be 326 Hz for a bubble with a 1 cm radius. Note that the term "bubble resonance frequency," and associated terms relating to bubble resonance are to be understood taking into account Minnaert resonance. The bubble point is known in the art from phase diagrams relating phase to the reservoir pressure and the reservoir temperature and indicate bubble point pressures 35 to 200 higher than the pressure $\gamma P_0$=100 kPα used in the Minnaert expression above. The dependence of the resonance frequency $f_r$ to the square root of the pressure indicates a resonance frequency 6 to 14 times larger than that given for the Minnaert expression. Depending on the bubble point pressure, the resonance frequencies for a 1 cm bubble would have a resonant frequency from approximately 2000 Hz to 4500 Hz. Smaller bubbles would encounter high frequencies and larger bubbles lower frequencies.

Furthermore, the terms μ and δ are dependent on the bubble size and frequency range approximately as:

$$\frac{1}{\mu} \approx 1 + b$$

$$\delta_* = \mu^2 b\left[1 - \frac{2b}{3(y-1)}\right] + f_*^3\left(\frac{3\mu^3}{a}\right)^{\frac{1}{2}} \cdot \frac{8\pi\eta f}{3\gamma P_0}$$

$$b \approx \frac{3}{2} \cdot \frac{y-1}{r}\left(\frac{K}{\pi\rho_G C_p f}\right)^{\frac{1}{2}}$$

The vapor fraction calculator 235 may thus be configured to calculate a vapor fraction value for the fluid medium based on the estimated bubble size and the measured signal speed or attenuation value, based on the relationships identified above.

Modules, Components, and Logic

Certain embodiments are described herein as including logic or a number of components, modules, or mechanisms. Modules may constitute either software modules, with code embodied on a non-transitory machine-readable medium (i.e., such as any conventional storage device, such as volatile or non-volatile memory, disk drives or solid state storage devices (SSDs), etc.), or hardware-implemented modules. A hardware-implemented module is a tangible unit capable of performing certain operations and may be configured or arranged in a certain manner. In example embodiments, one or more computer systems (e.g., a standalone, client, or server computer system) or one or more processors may be configured by software (e.g., an application or application portion) as a hardware-implemented module that operates to perform certain operations as described herein.

In various embodiments, a hardware-implemented module may be implemented mechanically or electronically. For example, a hardware-implemented module may comprise dedicated circuitry or logic that is permanently configured (e.g., as a special-purpose processor, such as a field programmable gate array (FPGA) or an application-specific integrated circuit (ASIC)) to perform certain operations. A hardware-implemented module may also comprise programmable logic or circuitry (e.g., as encompassed within a general-purpose processor or other programmable processor) that is temporarily configured by software to perform certain operations. It will be appreciated that the decision to implement a hardware-implemented module mechanically, in dedicated and permanently configured circuitry or in temporarily configured circuitry (e.g., configured by software), may be driven by cost and time considerations.

Accordingly, the term "hardware-implemented module" should be understood to encompass a tangible entity, be that an entity that is physically constructed, permanently configured (e.g., hardwired), or temporarily or transitorily configured (e.g., programmed) to operate in a certain manner and/or to perform certain operations described herein. Considering embodiments in which hardware-implemented modules are temporarily configured (e.g., programmed), each of the hardware-implemented modules need not be configured or instantiated at any one instance in time. For example, where the hardware-implemented modules comprise a general-purpose processor configured using software, the general-purpose processor may be configured as respective different hardware-implemented modules at different times. Software may accordingly configure a processor, for example, to constitute a particular hardware-implemented module at one instance of time and to constitute a different hardware-implemented module at a different instance of time.

Hardware-implemented modules can provide information to, and receive information from, other hardware-implemented modules. Accordingly, the described hardware-implemented modules may be regarded as being communicatively coupled. Where multiple of such hardware-implemented modules exist contemporaneously, communications may be achieved through signal transmission (e.g., over appropriate circuits and buses) that connect the hardware-implemented modules. In embodiments in which multiple hardware-implemented modules are configured or instantiated at different times, communications between such hardware-implemented modules may be achieved, for example, through the storage and retrieval of information in memory structures to which the multiple hardware-implemented modules have access. For example, one hardware-implemented module may perform an operation and store the output of that operation in a memory device to which it is communicatively coupled. A further hardware-implemented module may then, at a later time, access the memory device to retrieve and process the stored output. Hardware-implemented modules may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Similarly, the methods described herein may be at least partially processor-implemented. For example, at least some of the operations of a method may be performed by one or more processors or processor-implemented modules. The performance of certain of the operations may be distributed among the one or more processors, not only residing within a single machine, but deployed across a number of machines. In some example embodiments, the processor or processors may be located in a single location (e.g., within a home environment, an office environment or as a server farm), while in other embodiments the processors may be distributed across a number of locations.

The one or more processors may also operate to support performance of the relevant operations in a "cloud computing" environment or as a "software as a service" (SaaS). For example, at least some of the operations may be performed by a group of computers (as examples of machines including processors), with these operations being accessible via a network (e.g., the Internet) and via one or more appropriate interfaces (e.g., Application Program Interfaces (APIs).)

Figure 6:
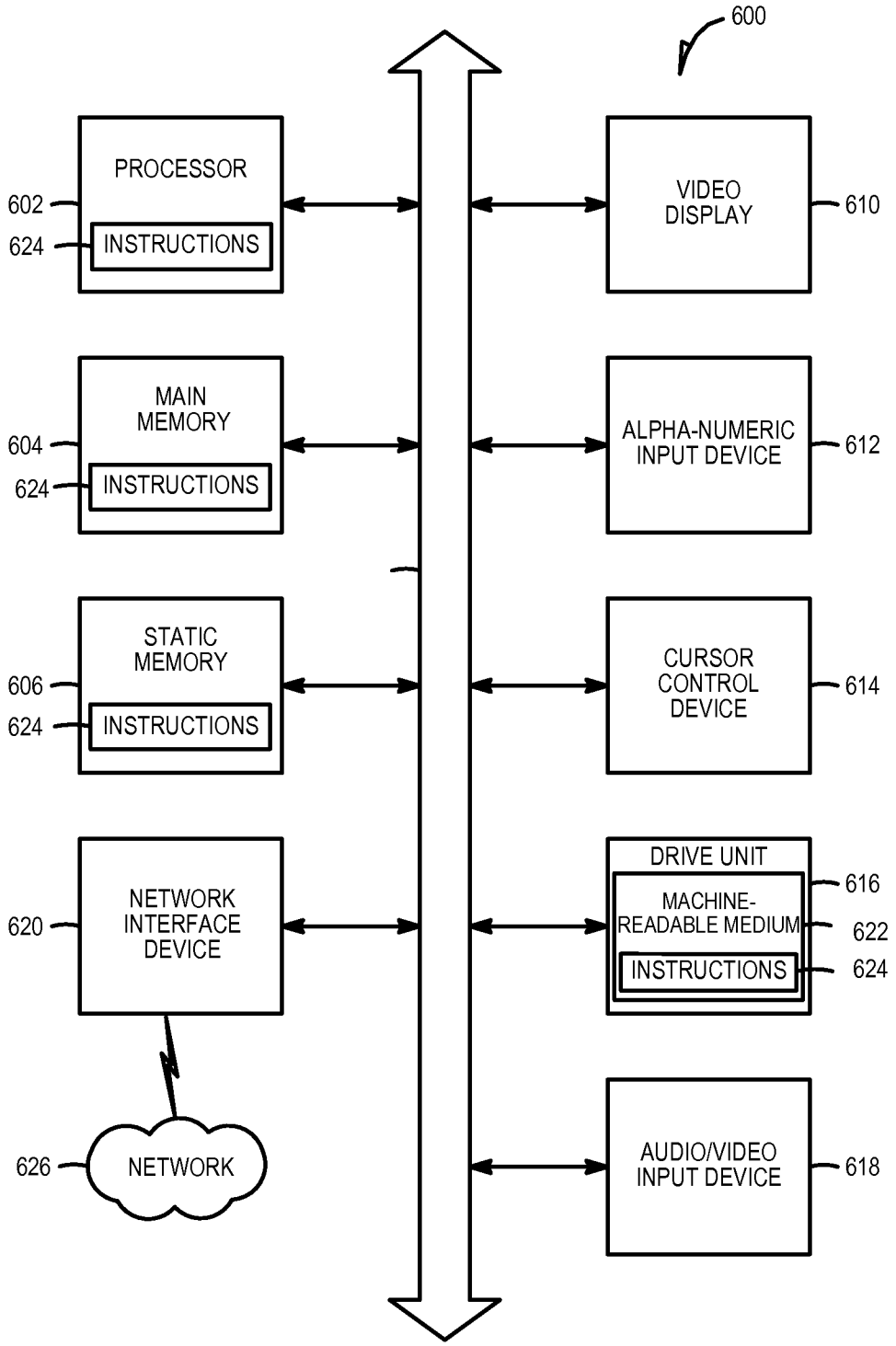
FIG. 6 is a diagrammatic representation of a machine in the example form of a computer system within which a set of instructions for causing the machine to perform any one or more of the automated method/operations disclosed herein may be executed.

FIG. 6 shows a diagrammatic representation of a machine in the example form of a computer system 600 within which a set of instructions, for causing the machine to perform any one or more of the methodologies discussed herein, may be executed. For example, the wellbore installation 100 (FIG. 1) or any one or more of its components (FIGS. 1 and 2) may be provided by the system 600.

In alternative embodiments, the machine operates as a standalone device or may be connected (e.g., networked) to other machines. In a networked deployment, the machine may operate in the capacity of a server or a client machine in a server-client network environment, or as a peer machine in a peer-to-peer (or distributed) network environment. The machine may be a server computer, a client computer, a personal computer (PC), a tablet PC, a set-top box (STB), a Personal Digital Assistant (PDA), a cellular telephone, a web appliance, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 600 includes a processor 602 (e.g., a central processing unit (CPU) a graphics processing unit (GPU) or both), a main memory 804 and a static memory 606, which communicate with each other via a bus 608. The computer system 600 may further include a video display unit 610 (e.g., a liquid crystal display (LCD) or a cathode ray tube (CRT)). The computer system 600 also includes an alpha-numeric input device 612 (e.g., a keyboard), a cursor control device 614 (e.g., a mouse), a disk drive unit 616, an audio/video input device 618 (e.g., a microphone/speaker) and a network interface device 620.

The disk drive unit 616 includes a machine-readable storage medium 622 on which is stored one or more sets of instructions (e.g., software 624) embodying any one or more of the methodologies or functions described herein. The software 624 may also reside, completely or at least partially, within the main memory 604 and/or within the processor 602 during execution thereof by the computer system 600, the main memory 604 and the processor 602 also constituting non-transitory machine-readable media.

The software 624 may further be transmitted or received over a network 626 via the network interface device 620.

While the machine-readable medium 622 is shown in an example embodiment to be a single medium, the term "machine-readable medium" should be taken to include a single medium or multiple media (e.g., a centralized or distributed database and/or associated caches and servers) that store the one or more sets of instructions. The term "machine-readable medium" shall also be taken to include any medium that is capable of storing a set of instructions for execution by the machine and that cause the machine to perform any one or more of the methodologies of this disclosure. The term "machine-readable medium" shall accordingly be taken to include, but not be limited to, solid-state memory devices of all types, as well as optical and magnetic media.

Therefore, as exemplified by the above-describe example systems and methods, various embodiments may be realized. These include a method of measuring fluid flow conditions in a wellbore, in which the method comprises exposing a fluid medium in the wellbore to an acoustic probe signal during fluid flow along the wellbore, the acoustic probe signal having a target frequency range that at least partially overlaps a particular bubble resonance frequency range comprising resonant frequencies for a range of individual bubble sizes characteristic of vapor bubble formation in the fluid medium during fluid flow in the wellbore; measuring one or more performance attributes of the acoustic probe signal in the particular bubble resonance frequency range, the one or more performance attributes comprising at least one of a speed parameter of the acoustic probe signal and an attenuation parameter of the acoustic probe signal; and, in an automated procedure based at least in part on the one or more measured performance attributes, determining a vapor fraction of the fluid medium in at least part of the wellbore, based at least in part on the one or more measured performance attributes of the acoustic probe signal.

In one embodiment, the acoustic probe signal is a transient signal, such as an acoustic pulse. The method may further comprise determining a bubble size parameter for vapor bubbles present in the fluid medium for at least part of the wellbore, the determining of the vapor fraction being based at least in part on the bubble size parameter. The bubble size parameter may comprise a collective bubble size value for a multitude of vapor bubbles present in the fluid medium for at least part of the wellbore, the collective bubble size value being statistically representative of individual bubble sizes for the multitude of vapor bubbles.

In some embodiments, determining of the bubble size parameter may comprise identifying an inflection frequency within the particular bubble resonance frequency range for the one or more measured performance attributes, and determining the bubble size parameter as a bubble size having a bubble resonance frequency substantially corresponding to the inflection frequency. The target frequency range may substantially span the particular bubble resonance frequency range, the identifying of the inflection frequency comprising measuring the one or more performance attributes of the acoustic probe signal at multiple frequencies within the particular bubble resonance frequency range, to determine multiple corresponding frequency-specific performance attribute values; identifying an inflection point within the particular bubble resonance frequency range for the multiple performance attribute values; and determining the inflection frequency based on correspondence with the inflection point.

Measuring the one or more performance attributes may comprise measuring frequency-specific speeds of the acoustic probe signal, the identifying of the inflection point comprising identifying, within the particular bubble resonance frequency range, a peak retardation frequency substantially corresponding to a minimum signal speed for the acoustic probe signal.

Measuring the one or more performance attributes may comprise measuring frequency-specific attenuation of the acoustic probe signal, the identifying of the inflection point comprising identifying, within the particular bubble resonance frequency range, a peak attenuation frequency substantially corresponding to a maximum attenuation level for the acoustic probe signal.

In some embodiments, the method may comprise generating the acoustic probe signal in a controlled sound creation operation. Instead, or in addition, the acoustic probe signal may comprise ambient sounds, such as noise generated in drilling or production operations in the wellbore. In some embodiments, the target range of the acoustic probe signal may include frequencies higher than 10 kHz. In other embodiments, the target range of the acoustic probe signal may include frequencies higher than 20 kHz. The target range may have an upper bound of about 50 kHz to 100 kHz.

Determining the vapor fraction may comprise determining a liquid-to-vapor ratio for the fluid medium in at least part of the wellbore. Measuring of the one or more performance attributes may comprise taking respective measurements at a plurality of measurement locations spaced along the wellbore, the determining of the vapor fraction comprising determining a plurality of vapor fraction values corresponding to the respective measurement locations. Measuring of the one or more performance attributes is by use of a fiber optic distributed acoustic sensor.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. A method of measuring fluid flow conditions in a wellbore, the method comprising:

exposing a fluid medium in the wellbore to an acoustic probe signal during fluid flow along the wellbore, the acoustic probe signal having a target frequency range that at least partially overlaps a particular bubble resonance frequency range comprising resonant frequencies for a range of individual bubble sizes characteristic of vapor bubble formation in the fluid medium during fluid flow in the wellbore;

measuring one or more performance attributes of the acoustic probe signal in the particular bubble resonance frequency range, the one or more performance attributes comprising at least one of a speed parameter of the acoustic probe signal and an attenuation parameter of the acoustic probe signal; and based at least in part on the one or more measured performance attributes of the acoustic probe signal, determining a vapor fraction of the fluid medium in at least part of the wellbore.

2. The method of claim 1, further comprising determining a bubble size parameter for vapor bubbles present in the fluid medium for at least part of the wellbore, the determining of the vapor fraction being based at least in part on the bubble size parameter.

3. The method of claim 2, wherein the bubble size parameter comprises a collective bubble size value for a multitude of vapor bubbles present in the fluid medium for at least part of the wellbore, the collective bubble size value being statistically representative of individual bubble sizes for the multitude of vapor bubbles.

4. The method of claim 2, wherein the determining of the bubble size parameter comprises:

identifying an inflection frequency within the particular bubble resonance frequency range for the one or more measured performance attributes; and determining the bubble size parameter as a bubble size having a bubble resonance frequency substantially corresponding to the inflection frequency.

5. The method of claim 4, wherein the target frequency range substantially spans the particular bubble resonance frequency range, the identifying of the inflection frequency comprising:

measuring the one or more performance attributes of the acoustic probe signal at multiple frequencies within the particular bubble resonance frequency range, to determine multiple corresponding frequency-specific performance attribute values;

identifying an inflection point within the particular bubble resonance frequency range for the multiple performance attribute values; and determining the inflection frequency based on correspondence with the inflection point.

6. The method of claim 5, wherein measuring the one or more performance attributes comprises measuring frequency-specific speeds of the acoustic probe signal, the identifying of the inflection point comprising identifying, within the particular bubble resonance frequency range, a peak retardation frequency substantially corresponding to a minimum signal speed for the acoustic probe signal.

7. The method of claim 5, wherein measuring the one or more performance attributes comprises measuring frequency-specific attenuation of the acoustic probe signal, the identifying of the inflection point comprising identifying, within the particular bubble resonance frequency range, a peak attenuation frequency substantially corresponding to a maximum attenuation level for the acoustic probe signal.

8. The method of claim 1, further comprising generating the acoustic probe signal in a controlled sound creation operation.

9. The method of claim 1, wherein the acoustic probe signal comprises ambient sounds in the wellbore.

10. The method of claim 1, wherein the target frequency range includes frequencies higher than 20 Hz.

11. The method of claim 1, wherein the target frequency range includes frequencies higher than 50 kHz.

12. The method of claim 11, wherein the transient signal comprises a broadband acoustic pulse.

13. The method of claim 1, wherein the acoustic probe signal comprises a transient signal.

14. The method of claim 1, wherein determining the vapor fraction comprises determining a liquid-to-vapor ratio for the fluid medium in at least part of the wellbore.

15. The method of claim 1, wherein the measuring of the one or more performance attributes comprises taking respective measurements at a plurality of measurement locations spaced along the wellbore, the determining of the vapor fraction comprising determining a plurality of vapor fraction values corresponding to the respective measurement locations.

16. The method of claim 15, wherein the measuring of the one or more performance attributes is by use of a fiber optic distributed acoustic sensor.

17. The method of claim 1, wherein determining a vapor fraction of the fluid medium is done in an automated operation.

18. A system for measuring fluid flow conditions in a wellbore, the system comprising:

an acoustic source configured to generate an acoustic probe signal in a fluid medium in the wellbore during fluid flow along the wellbore, the acoustic probe signal having a target frequency range that at least partially overlaps a particular bubble resonance frequency range comprising resonant frequencies for a range of individual bubble sizes characteristic of vapor bubble formation in the fluid medium during fluid flow in the wellbore;

an acoustic sensor configured to measure one or more performance attributes of the acoustic probe signal in the particular bubble resonance frequency range, the one or more performance attributes comprising at least one of a speed parameter of the acoustic probe signal and an attenuation parameter of the acoustic probe signal; and a vapor fraction calculator configured to determine a vapor fraction of the fluid medium in at least part of the wellbore, based at least in part on the one or more measured performance attributes of the acoustic probe signal.

19. The system of claim 18, further comprising a bubble size estimator configured to determine a bubble size parameter for vapor bubbles present in the fluid medium for at least part of the wellbore, the vapor fraction calculator being configured to determine the vapor fraction based at least in part on the bubble size parameter.

20. The system of claim 19, wherein the bubble size estimator is configured to:

identify an inflection frequency within the particular bubble resonance frequency range for the one or more measured performance attributes; and determine the bubble size parameter as a bubble size having a bubble resonance frequency substantially corresponding to the inflection frequency.

21. The system of claim 18, further comprising a signal generator configured to generate the acoustic probe signal.

* * * * *